US008772665B2

(12) United States Patent
An

(10) Patent No.: US 8,772,665 B2
(45) Date of Patent: Jul. 8, 2014

(54) CIRCUIT BREAKER WITH ARC EXTINGUISHING MECHANISM

(75) Inventor: Young Gyu An, Chungcheongbuk-Do (KR)

(73) Assignee: LSIS Co., Ltd., Anyang, Gyeonggi-Do (KR)

( * ) Notice: Subject to any disclaimer, the term of this patent is extended or adjusted under 35 U.S.C. 154(b) by 215 days.

(21) Appl. No.: 13/345,627

(22) Filed: Jan. 6, 2012

(65) Prior Publication Data

US 2012/0211469 A1 Aug. 23, 2012

(30) Foreign Application Priority Data

Feb. 22, 2011 (KR) ..... 20-2011-0001489 U

(51) Int. Cl.
*H01H 9/40* (2006.01)

(52) U.S. Cl.
USPC ..... 218/34; 218/16; 218/149; 218/156

(58) Field of Classification Search
USPC ..... 218/156, 16, 34, 149
See application file for complete search history.

(56) References Cited

U.S. PATENT DOCUMENTS

| | | | | |
|---|---|---|---|---|
| 7,034,642 | B1 * | 4/2006 | Rakus et al. | 335/16 |
| 2001/0007318 | A1 * | 7/2001 | Rival et al. | 218/156 |
| 2005/0263492 | A1 * | 12/2005 | McCoy | 218/34 |
| 2006/0086693 | A1 * | 4/2006 | Yeon | 218/149 |
| 2009/0283500 | A1 * | 11/2009 | Yanase et al. | 218/1 |

FOREIGN PATENT DOCUMENTS

| | | |
|---|---|---|
| CN | 2013-74295 | 12/2009 |
| CN | 1770351 | 5/2010 |
| DE | 3619241 | 7/1994 |
| EP | 0299460 | 1/1989 |
| JP | 63-257138 | 10/1988 |
| JP | 01-063043 | 4/1989 |
| JP | 06-020550 | 1/1994 |
| JP | 08-185785 | 7/1996 |
| JP | 10-012117 | 1/1998 |
| JP | 2002-251934 | 9/2002 |
| JP | 2006-059758 | 3/2006 |
| JP | 2006-120643 | 5/2006 |
| JP | 2008-186643 | 8/2008 |
| JP | 2010-251299 | 11/2010 |

OTHER PUBLICATIONS

Japan Patent Office Application Serial No. 2012-010766, Office Action dated Jan. 29, 2013, 3 pages.
The State Intellectual Property Office of the People's Republic of China Application Serial No. 201210041757.6, Office Action dated Jan. 6, 2014, 5 pages.
European Patent Office Application Serial No. 12151736.1, Office Action dated Mar. 5, 2014, 4 pages.

* cited by examiner

*Primary Examiner* — Truc Nguyen
(74) *Attorney, Agent, or Firm* — Lee, Hong, Degerman, Kang & Waimey

(57) ABSTRACT

A circuit breaker having an arc extinguishing mechanism includes a plurality of grids disposed in a longitudinal direction, each having protruding portions at both ends thereof so as to define a space therebetween, a fixing portion to support the grids, insulating plates fixed to both sides of the grids, a stator located below the grids, the stator including an arc runner and a stationary contact disposed at an upper side of the arc runner, and a mover contactable with or separated from the stationary contact with moving up and down within the space, wherein an interval between the insulating plates within the space is shorter than a width of the mover.

3 Claims, 4 Drawing Sheets

CIRCUIT BREAKER WITH ARC EXTINGUISHING MECHANISM

CROSS-REFERENCE TO RELATED APPLICATION

Pursuant to 35 U.S.C. §119(a), this application claims the benefit of earlier filing date and right of priority to Korean Patent Application No. 20-2011-0001489, filed on Feb. 22, 2011, the contents of which are hereby incorporated by reference in its entirety.

BACKGROUND OF THE INVENTION

1. Field of the Invention

This specification relates to a circuit breaker with an arc extinguishing mechanism, and particularly, to a circuit breaker with an arc extinguishing mechanism for extinguishing arc generated when a movable contactor is separated from a stationary contactor due to a fault current.

2. Background of the Invention

A circuit breaker is an electric device for protecting a circuit and a line by automatically breaking such circuit or line upon occurrences of an electric overload state or a short-circuit state. In general, current flowing over an electric circuit is generally divided into a rated current and a fault current which flows due to a breakdown like short-circuit, grounding, etc.

The fault current is drastically larger than the rated current, so it is difficult to be cut off. Accordingly, the circuit breaker is designed to block both the rated current and the fault current. A rated switch is able to merely block a current, which is as low as the rated current, so it is distinguished from the circuit breaker. An electric power system includes a power generator, a transformer, a power transmission line and the like. When desiring to suspend some of them, a current of the power generator or power transmission line desired to be suspended is blocked by a circuit breaker such that the power generator or power transmission line can be isolated from the electric power system. Also, when a breakdown such as short-circuit or grounding is caused in the system, an extremely large fault current flows over the system. If the system is left in that state, it may aggravate damage on the broken component or portion and the other may also be out of order due to large current. Thus, the circuit breaker is used for blocking the broken portion.

In general, the circuit breaker exhibits more excellent current limitation when it has superior arc extinguishing capability and takes a shorter time to break current. FIG. 1 is a schematic view showing a structure of the related art circuit breaker, FIG. 2 is a disassembled perspective view showing a structure of an arc extinguishing mechanism of the related art circuit breaker, FIG. 3 is a view showing operations of the related art arc extinguishing mechanism, and FIG. 4 is a planar view showing an exhausting direction of arc generated from the related art circuit breaker.

As shown in FIG. 1, the related art circuit breaker 100 includes a first stator 110 implemented as a conductor to induce current to flow inwardly, a mover 130 selectively contactable with the first stator 110 by a mechanical operation of a switching mechanism 120, an arc extinguishing mechanism 140 to extinguish arc generated between contact points of the mover 130 and the first stator 110, a connecting contactor 150 coupled with one end of the mover 130, a second stator 160 connected to the connector 150 and implemented as a conductor to induce a current to flow outwardly, a trip mechanism 170 to operate the switching mechanism 120 by detecting a generation of a fault current and abnormal current, and a handle 180 to manually drive the switching mechanism 120.

As shown in FIG. 2, the arc extinguishing mechanism 140 of the related art circuit breaker 100 includes a first stator 141 and a mover 142. A stationary contact 141*a* and a movable contact 142*a* are brazed at the first stator 141 and the mover 142, respectively. A rear end of the stationary contact 141*a* is embossed to act as an arc runner 141*b*. A position adjacent to the first stator 141 and the mover 142 is shown having an arc chute 143. The arc chute 143 includes a plurality of grids 143*a* made of a metal having ferromagnetism, and fixing plates 143*b* made of an insulating material to fix the grids 143*a*. The first stator 141, the upper grid 144 and the arc chute 143 are integrally assembled together and mounted in a case 145 made of an insulating material.

An operation of the arc extinguishing mechanism of the related art circuit breaker is described as follows.

Referring to FIG. 3, in the related art circuit breaker 100, the stationary contact 141*a* and the movable contact 142*a* remain contacted while a rated current flows. However, when a fault current such as overcurrent or short-circuit current, is generated, the mover 142 is separated due to an electromagnetic repulsive force, which is generated between the stationary contact 141*a* and the movable contact 142*a*, thereby cutting off current. When the mover 142 is separated, arc is generated between the stationary contact 141*a* and the movable contact 142*a*. The generated arc is induced to the arc runner 141*b* to flow to the arc chute 143. The arc is segmented by the grids 143*a* of the arc chute 143, thereby increasing an arc voltage to be higher than a power source voltage, which limits the short-circuit current and results in extinguishing arc. Also, the arc extinguishing effect is obtained by arc extinguishing gas, which is generated from the insulating plates 143*b* which fix the grids 143*b* of the arc chute 143.

However, in the arc extinguishing mechanism of the related art circuit breaker, after arc generated due to a rotary motion of the mover 142 flows to the arc chute 143 through the arc runner 141*b*, when the arc is elongated within the arc chute 143, an arc column is not induced up to the upper grid 144, it is impossible to obtain a significant increase in an arc voltage. Also, the insulating plates 143*b* for supporting the grids 143*a* are unable to generate significant extinguishing gas due to arc energy. Hence, it is impossible to expect an increase in the arc voltage in response to an increase in pressure. Also, referring to FIG. 4, the arc extinguishing mechanism of the related art circuit breaker extinguishes arc merely by segmenting arc into various directions a, b, c by the grids 143*a* and cooling arc, so it takes a long time to extinguish arc and also arc heat gas is reversely exhausted in a direction d where the rotational shaft of the mover 142 is installed, which causes problems of arc reignition and damage on the movable contact 142*a* and the stationary contact 141*a*.

SUMMARY OF THE INVENTION

Therefore, to address the drawbacks of the related art, an aspect of the detailed description is to provide an arc extinguishing mechanism for a circuit breaker capable of uniformly distributing arc, generated upon breaking a fault current, into grids so as to improve arc extinguishing efficiency.

To achieve these and other advantages and in accordance with the purpose of this specification, as embodied and broadly described herein, there is provided a circuit breaker including a plurality of grids disposed in a longitudinal direction, each having protruding portions at both ends thereof so as to define a space therebetween, a fixing portion to support the grids, insulating plates fixed to both sides of the grids, a stator located below the grids, the stator including an arc runner and a stationary contact disposed at an upper side of the arc runner, and a mover contactable with or separated from the stationary contact with moving up and down within the space, wherein an interval between the insulating plates within the space is shorter than a width of the mover.

In accordance with the aspect, the interval between the pair of insulating plates can be shorter than a width of the mover, namely, end portions of the insulating plates can protrude into the space, so as to allow the generated arc to be more smoothly introduced into the grids and simultaneously increase an amount of arc extinguishing gas generated by the insulating plates, thereby improving an arc extinguishing performance.

Here, the insulating plates may include first insulating plates disposed at both sides of the grids, and second insulating plates coupled to the first insulating plates and extending into the space. Each of the second insulating plates may include a coupling portion coupled to the first insulating plate, and an inclined portion extending from the coupling portion toward the grids with an inclination.

Also, the second insulating plates may be located between the protruding portions of the grids and the mover.

In addition, the interval between the insulating plates within the space can be shorter than a width of the arc runner, to allow more arc to be introduced into the grids.

In accordance with the aspects of the present disclosure with the configuration, arc generated during a breaking operation can be introduced more into grids and a contact area between the arc and the insulating plates can be increased, resulting in enhancement of arc extinguishing efficiency.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of a circuit breaker in accordance with the exemplary embodiments, with reference to the accompanying drawings. For the sake of brief description with reference to the drawings, the same or equivalent components will be provided with the same reference numbers, and description thereof will not be repeated.

Figure 1:
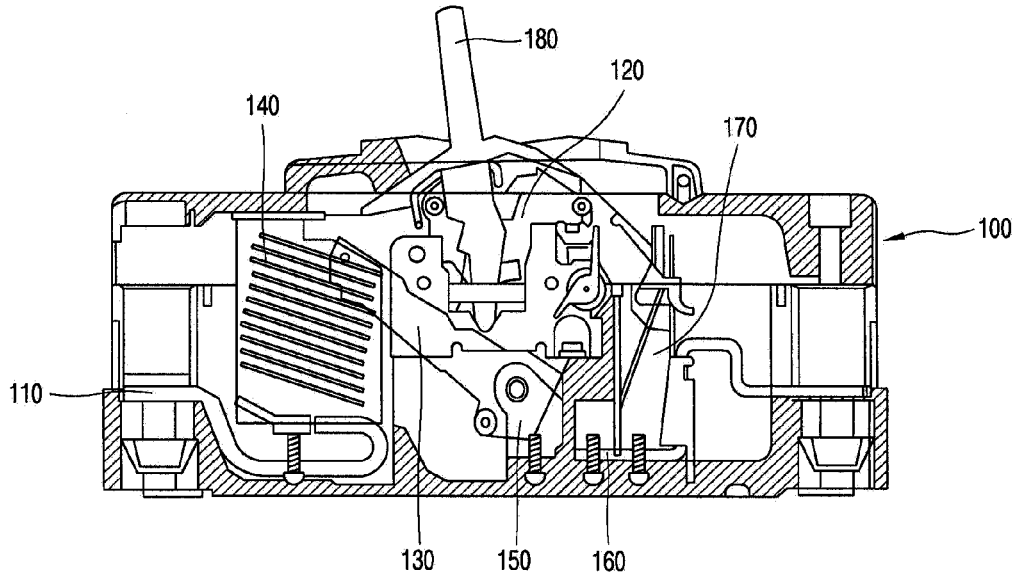
FIG. 1 is a sectional view schematically showing a structure of the related art circuit breaker.
Figure 2:
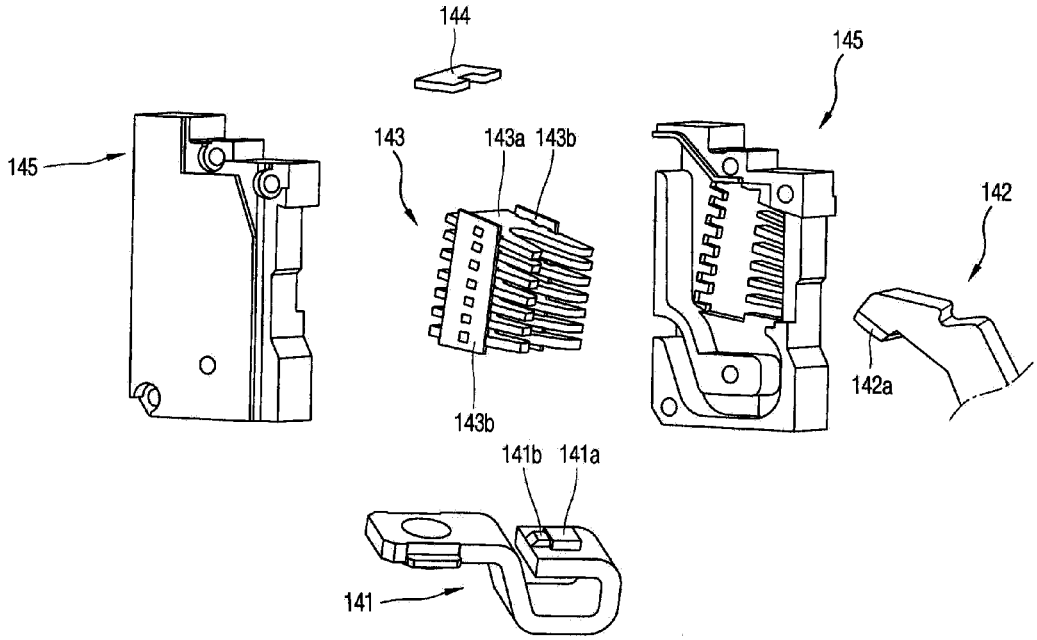
FIG. 2 is a disassembled perspective view showing a structure of an arc extinguishing mechanism of the related art circuit breaker.
Figure 3:
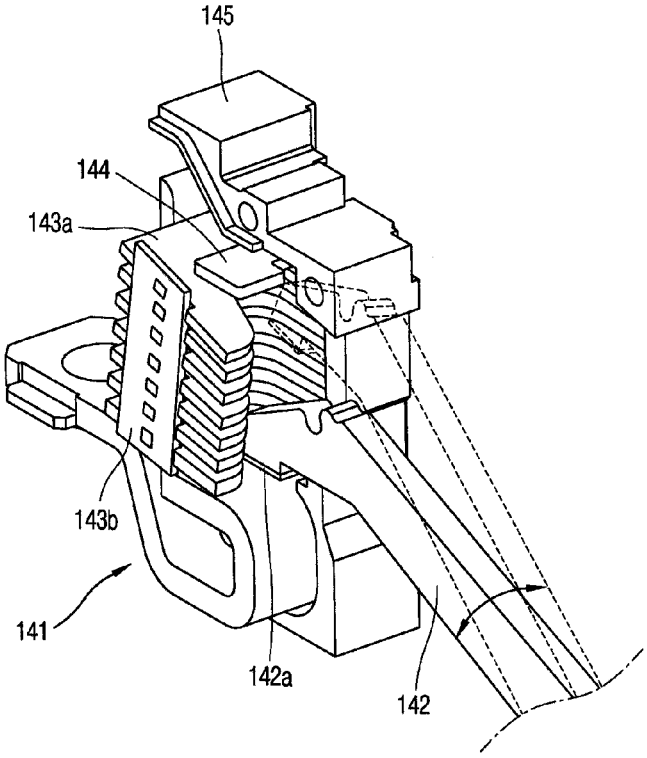
FIG. 3 is a view showing operations of the related art arc extinguishing mechanism.
Figure 4:
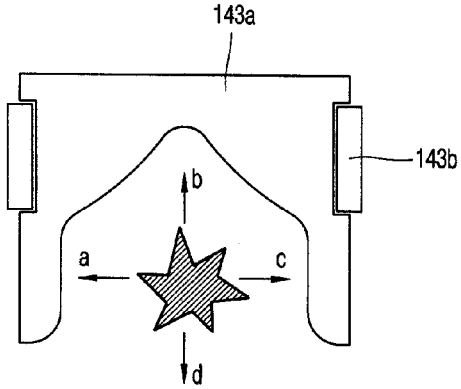
FIG. 4 is a planar view showing an exhausting direction of arc generated from the related art circuit breaker.
Figure 5:
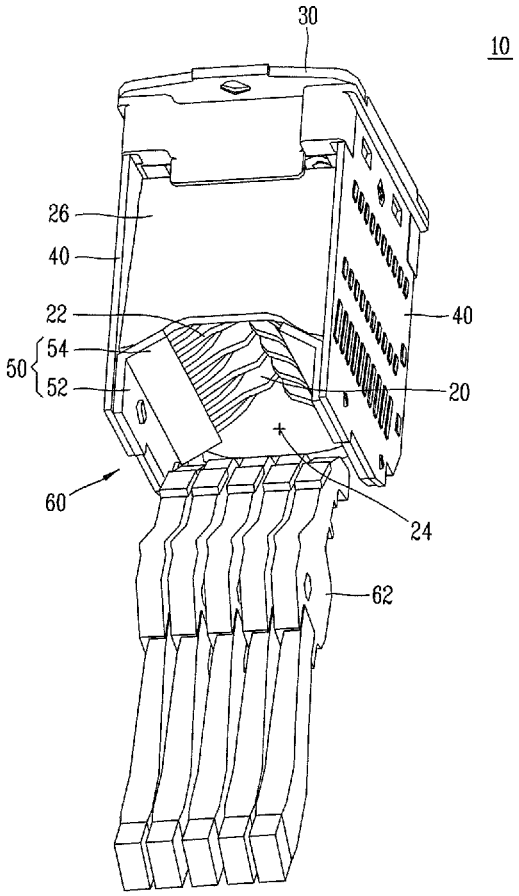
FIG. 5 is a perspective view showing one exemplary embodiment of a circuit breaker in accordance with this specification.
Figure 6:
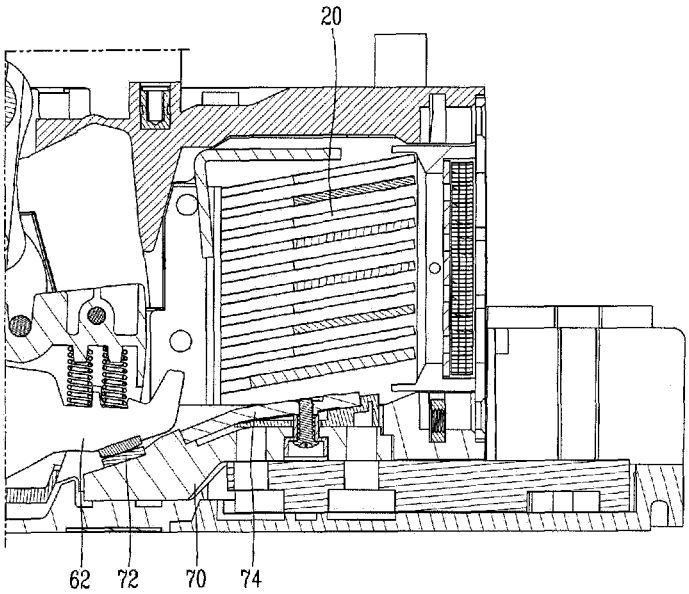
FIG. 6 is a sectional view of the one exemplary embodiment shown in FIG. 5.
Figure 7:
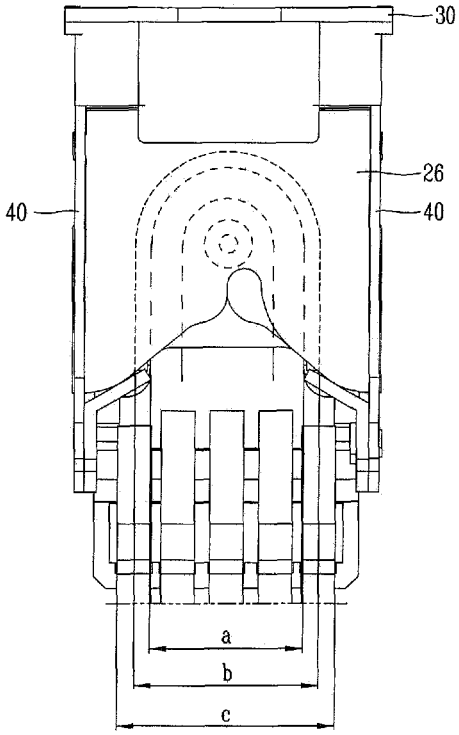
FIG. 7 is a planar view of the one exemplary embodiment shown in FIG. 5.

FIG. 5 is a perspective view showing one exemplary embodiment of a circuit breaker in accordance with this specification, FIG. 6 is a sectional view of the one exemplary embodiment shown in FIG. 5, and FIG. 7 is a planar view of the one exemplary embodiment shown in FIG. 5.

Referring to FIGS. 5 to 7, a circuit breaker 10 in accordance with the exemplary embodiment may include plural sheets of grids 20 laminated in a longitudinal (vertical) direction with predetermined intervals.

The grid 20 may be made of a metal having ferromagnetism. Protruding portion 22 may be formed at both ends at the front of each grid 20 based on FIG. 5. A space formed between the protruding portions 22 may define an arc extinguishing space 24 in which arc generated due to a longitudinal (vertical, up-and-down) motion of a mover to be explained later is diffused and extinguished. Here, an upper grid 26 may be located on the top of the grid 20. The upper grid 26 may obscure the upper side of the arc extinguishing space 24 to prevent the generated arc from being leaked out of the top of the grid 20.

A fixing portion 30 may be installed at the rear of the grids 20. The fixing portion 30 may serve to fix the grids 20 such that the grids 20 can remain in the fixed state with the predetermined intervals. In addition, the fixing portion 30 may be secured with a circuit breaker main body (not shown).

First insulating plates 40 may be fixed to both side surfaces of the girds 20. The first insulating plates 40 may prevent arc leakage to the outside in cooperation with the upper grid 26 and also serve to fix the grids 20. The first insulating plates 40 may be made of a material, which is able to generate arc extinguishing gas when contacting arc, so as to rapidly extinguish such arc.

The first insulating plates 40 may be formed longer than the grids 20 such that their front sides can protrude from the front sides of the grids 20. Second insulating plates 50 may be fixed onto the protruded portions. Each of the second insulating plates 50, as shown in FIG. 5, may include a coupling portion 52 coupled to the first insulating plate 40, and an inclined portion 54 extending from the coupling portion 52 with being inclined to the inside of the arc extinguishing space. Hence, an interval a between ends of the inclined portions 54 may be shorter than an interval between the coupling portions 52.

A mover 60 may be installed at the front of the second insulating plates 50. The mover 60 may have the same structure as the mover of the typical circuit breaker. The mover 60 may include a plurality of movable contactors 62 disposed in series.

A stator 70 may be disposed below the mover 60. The stator 70 may include a stationary contact 72 contacting the mover 60, and an arc runner 74 to induce arc generated during a breaking process. Here, referring to FIG. 5, the relation among the interval a between the inclined portions 54, the width b of the arc runner 74 and the width c of the mover 60 may be explained as follows.

$a<b<c$

Hereinafter, description will be given of operations of the circuit breaker according to the one exemplary embodiment.

In a normal state that the mover 60 and the stator 70 contact each other to allow a current flow, when the mover 60 is separated by an electromagnetic repulsive force, which is generated between the stationary contact 72 and the mover 60 upon generation of a fault current due to a particular cause, arc is generated between the two electrodes. Here, the arc is induced to the arc runner 74 after staying at the stationary contact 72 for a short term of time. The arc induced to the arc runner 74 then generates arc extinguishing gas from the first and second insulating plates 40 and 50, which define inner walls of the arc extinguishing space.

Here, the generated arc extinguishing gas compresses and elongates an arc column by pressure, which is instantaneously rapidly risen in the arc extinguishing space, so as to render an arc voltage high, thereby improving a current limitation performance (efficiency). The arc then rapidly moves into the grids 20 by an attractive force and pressure by a magnetism generated by the grids 20, so as to be segmented and cooled.

Here, the second insulating plates 50 protrude into the arc extinguishing space, so the arc can generate the arc extinguishing gas by contacting the insulating plates 50 more rapidly. In addition, the inclined portions 54 of the second insulating plates 50 can additionally shield the arc extinguishing space. Accordingly, upon the arc generation, pressure within the arc extinguishing space can be further increased, which can make the arc diffused more rapidly into the grids 20.

The inclined portions 54 of the second insulating plates 50 can also prevent the arc from being reversely exhausted toward the mover 60. Consequently, metal particles, which are melted by heat gas and arc heat within the arc extinguishing space can be prevented from being exhausted toward the mover 60. This may result in prevention of damages of the stationary contact 72 and the mover 60 and prevention of reignition due to the reverse exhaust of the arc, which is ended up with improvement of a current limitation effect.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A circuit breaker comprising:

a plurality of grids laminated in a longitudinal direction, each of the plurality of grids comprising protruding portions extending from opposing sides of a front edge of the corresponding grid, the protruding portions defining a space therebetween;

a fixing portion positioned along a back edge of each of the plurality of grids and configured to support each of the plurality of grids;

a pair of first insulating plates fixedly connected to the opposing sides of each of the plurality of grids;

a pair of second insulating plates, each of the pair of second insulating plates comprising a coupling portion coupled to a corresponding first insulating plate and an inclined portion that extends toward the plurality of grids into the space defined by the protruding portions such that an interval between the inclined portions is smaller than an interval between the coupling portions;

a stator located below the plurality of grids, the stator comprising an arc runner and a stationary contact disposed on an upper side of the arc runner; and a mover configured to move toward and away from the stator and to contact and separate from the stationary contact in response to the movement, wherein the stationary contact and the mover are configured to generate an arc therebetween during a breaking process in which the mover separates from the stationary contact, wherein the stator is configured to induce the generated arc from the stationary contact to the arc runner, and wherein the interval between the inclined portions is substantially constant and smaller than a width of the arc runner passing edges of the pair of second insulating plates that define the interval between the inclined portions such that the generated arc induced onto the arc runner contacts at least one of the pair of second insulating plates.

2. The circuit breaker of claim 1, wherein the inclined portions are positioned between the protruding portions of each of the plurality of grids and the mover.

3. The circuit breaker of claim 1 wherein the interval between the inclined portions is smaller than a width of the mover.

* * * * *